United States Patent [19]

Eberhardt et al.

[11] 3,999,394

[45] Dec. 28, 1976

[54] PRECAST RIBBED ARCH SUBWAY STRUCTURE AND METHOD

[76] Inventors: William H. Eberhardt, 3 Wheatley Ave., East Williston, N.Y. 11596; Sidney H. Bingham, 109 E. 35th St., New York, N.Y. 10016

[22] Filed: Mar. 29, 1976

[21] Appl. No.: 670,551

[52] U.S. Cl. ..... 61/44; 52/301; 52/585; 404/71

[51] Int. Cl.[2] ..... E01G 4/02; E01C 9/00

[58] Field of Search ..... 61/44, 43, 42, 41 A; 404/71; 52/585, 301

[56] References Cited

UNITED STATES PATENTS

| | | | |
|---|---|---|---|
| 654,426 | 7/1900 | Washington | 61/44 |
| 813,183 | 2/1906 | Tresidder | 52/301 |
| 960,125 | 5/1910 | Tresidder | 52/585 X |
| 1,472,602 | 10/1923 | Lally | 52/301 |
| 1,948,114 | 2/1934 | Janssen | 61/44 X |
| 2,194,279 | 3/1940 | Goldsborough | 61/44 |
| 2,664,977 | 1/1954 | Starcevich | 52/301 |
| 3,473,273 | 10/1969 | Gunkel | 52/585 X |
| 3,693,308 | 9/1972 | Trezzini et al. | 52/585 X |

FOREIGN PATENTS OR APPLICATIONS

| | | | |
|---|---|---|---|
| 418,703 | 3/1947 | Italy | 61/44 |

*Primary Examiner*—Dennis L. Taylor

[57] ABSTRACT

The invention relates to construction of subways or the like using precast, prestressed, ribbed arch concrete panels to build subways with or without utility chambers and above or below ground water. One approach constructs a subway without utility chamber substantially entirely through the use of the concrete panels while the other constructs a subway with utility chamber utilizing poured concrete walls for the utility chamber with the procedure being adapted to a cut and cover method for minimal influence on traffic flow and the train tunnel being formed of the concrete panels.

17 Claims, 44 Drawing Figures

PRECAST RIBBED ARCH SUBWAY STRUCTURE AND METHOD

PRIOR ART

The prior art, for seventy-five or more years relating to the construction of subways, is of the tailor-made type, i.e., a typical subway structure in earth structure or partly in rock above ground water utilized many steps, but basically, construction is generally made in 50-foot lengths as the concrete forms and the like must be retained in position three or more days for the concrete to set up.

The prior art was considerably improved upon in U.S. Pat. No. 3,914,946 filed Oct. 31, 1974, by the present inventors, which patent issued Oct. 28, 1975. The patent is entitled "Cut and Cover Construction of Subway with Utility Chamber and Air Conditioning with Minimum Street Traffic Disturbance and Method." The patented invention requires far fewer steps, interferes with traffic considerably less, and enables construction, which had heretofore been temporary, to be incorporated into the final structure.

Our prior invention generally relates to the following construction steps: (A) forming spaced apart pits or trenches along the outer edges of the subway site which can be immediately covered with steel plates to permit normal traffic flow; (B) the plates are removed and soldier beams placed at spaced positions in each pit; (C) as excavation proceeds, timber lagging is inserted between the soldier beams. When the excavation is made between the soldier beams, (D) timer bracing and caps are installed across the tops of the soldier beams to receive the precast decking. (E) Further soldier beams are then driven between the aforementioned soldier beams after the decking and bracing are removed. (F) Excavation then can be made to permit construction of concrete walls along said further soldier beams longitudinally to comprise the outermost edges thereof. (G) Sewer and gas mains are then laid exterior of the concrete wall(s) to permit ready connection to dwellings or buildings. (H) Trenches are formed laterally of the subway site at spaced apart locations to receive decking beams which are covered by concrete decking as excavation proceeds. The concrete decking is removed when sufficient trenches have been made to (I) erect the steel decking beams, and the concrete decking is then placed on the decking beam supports. Portions of the concrete decking are to be made removable when street traffic permits to provide access for construction equipment and materials. (J) Excavation is made to a level below all utilities. (K) The utilities are supported from the decking beams by suitable hangers and cradles.

Covering the excavated areas as work proceeds permits a free flow of highway traffic during peak hours.

The utility chamber greatly reduces costly disturbances of utilities during construction and by a rental agreement with the utility companies can be a substantial source of nonoperating revenue.

The utility chamber may also be used as an air conditioning duct for the subway.

INVENTION

The present invention relates to a novel subway structure and method capable of rapid construction through the unique deployment of various types of precast, prestressed, ribbed arch concrete panels easily assembliable into a different type structure for two or four track trains and with or without utility chambers. The invention includes embodiments improving over the prior art currently in use and embodiments improving over our patent.

The invention discloses subway section construction in earth structure, above and below ground water between stations, at stations, and approaches to stations, with the preferred embodiment making provision for an overhead utility chamber.

A large number of steps are avoided in each of the foregoing constructions through the use of the panel approach herein described. For example, in constructing a typical section under the currently used prior art arrangement for above ground water conditions, generally twenty-two steps (many of which are multiple part) are required.

Reference to the following Construction Procedure Tables show that, in general, for the prior art currently in use above ground water construction, these particular steps are listed in Column A, as follows:

1. Break holes in pavement.
2. Drive soldier beams.
5. Relocate sewers and gas lines exterior to subway site.
6. Excavate between soldier beams to uncover utilities.
7. Install decking beams and decking.
8. Suspend utilities from decking beams.
9. Excavate to subgrade.
12. Pour invert concrete and toe bench.
13. Erect steel bents.
18. Lay duct banks.
19. Erect forms and pour concrete to top of duct bank.
20. Erect forms for side walls and interior wall.
24. Pour side wall concrete arches and interior wall.
25. Erect forms for roof arches.
26. Pour roof concrete arches.
27. Apply waterproofing.
29. Pour protective concrete.
30. Support utilities on subway roof.
31. Backfill over roof.
32. Construct temporary roadway.
33. Restore roadway surface.

Additional steps are required in the event ground water is encountered in prior art excavation as set forth in Column B. These steps include:

10. Pour invert protection concrete.
11. Apply waterproofing.
14. Pour invert concrete.
16. Pour protection concrete to top of duct bank.
17. Apply waterproofing.
21. Pour protective concrete.
22. Apply waterproofing.
23. Erect forms for side wall arches and interior wall. (Note this step is the same as 20 but in different sequence of time)

In summary then, with respect to the prior art of Columns A and B, ten steps are required which are not required in either of the new construction embodiments. These steps are the time-consuming or expensive steps in subway construction today. They include:

13. Erect steel bents.
16. Pour protective concrete to top of duct bank.
17. Apply waterproofing.
18. Lay duct banks.

19. Erect forms and pour concrete to top of duct bank.
20. (23). Erect forms for side walls and interior wall.
24. Pour side wall concrete arches and interior wall.
25. Erect forms for roof arches.
26. Pour roof concrete arches.

Thus, an important object of the present invention is to avoid the requirement of, not only carrying out these steps in constructing a subway, but also, the requirement for the materials, forms, and foot-by-foot or tailor-made construction.

The first embodiment of the present invention relates to a subway without provision for a utility chamber but incorporating the prestressed, ribbed arch concrete panels. Column C lists the construction steps for above ground water conditions as follows:

1. Break holes in pavement.
2. Drive soldier beams.
5. Relocate sewers and gas lines exterior to subway site.
6. Excavate between soldier beams to uncover utilities.
7. Install decking beams and decking.
8. Suspend utilities from decking beams.
9. Excavate to subgrade.
14. Pour invert concrete.
15. Erect precast concrete structure.
27. Apply waterproofing.
29. Pour protective concrete.
30. Support utilities on subway roof.
31. Sandfill in back of side wall panels and backfill over roof.

32. Construct temporary roadway.
33. Restore roadway surface.

Thus, a savings of seven steps over Column A is realized.

Column D lists the additional construction steps where below ground water conditions obtain in a subway without utility chamber as follows:

10. Pour invert protection concrete.
11. Apply waterproofing.
12. Pour invert concrete and toe bench.
21. Pour protective concrete.
22. Apply waterproofing.

This results in a savings of seven steps over Column B.

A preferred embodiment of the invention which utilizes a portion of the teachings of our patent in a novel method and new combination structure describes subway construction with provision for utility chamber with above ground water steps being steps (A)–(K) above set forth from our prior patent in lieu of steps 1–8 in Column E and the steps set forth in Column E, as follows:

9. Excavate to subgrade.
14. Pour invert concrete.
15. Erect precast concrete structure.
28. Construct duct banks (in utility chamber).
30. Support utilities on subway roof.
31. Sandfill.
33. Restore roadway surface.

Finally, Column F sets forth the additional steps for this subway construction when ground water is encountered as follows:

10. Pour invert protection concrete.
11. Apply waterproofing.

CONSTRUCTION PROCEDURE TABLE

| | PRIOR ART SECTION | | NEW SECTION WITHOUT UTILITY CHAMBER | | NEW SECTION WITH UTILITY CHAMBER | |
|---|---|---|---|---|---|---|
| | Col. A | Col. B | Col. C | Col. D | Col. E | Col. F |
| | Above Ground Water | Below Ground Water | Above Ground Water | Below Ground Water | Above Ground Water | Below Ground Water |
| 1 | x | x | x | x | | |
| 2 | x | x | x | x | | |
| 3 | | | | | | |
| 4 | | | | | | |
| 5 | x | x | x | x | | |
| 6 | x | x | x | x | | |
| 7 | x | x | x | x | | |
| 8 | x | x | x | x | | |
| 9 | x | x | x | x | x | x |
| 10 | | x | | x | | x |
| 11 | | x | | x | | x |
| 12 | x | | | x | | |
| 13 | x | x | | | | |
| 14 | | x | x | x | x | x |
| 15 | | | x | x | x | x |
| 16 | | x | | | | |
| 17 | | x | | | | |
| 18 | x | x | | | | |
| 19 | x | x | | | | |
| 20 | x | | | | | |
| 21 | | x | | x | | |
| 22 | | x | | x | | |
| 23 | | x | | | | |
| 24 | x | x | | | | |
| 25 | x | x | | | | |
| 26 | x | x | | | | |
| 27 | x | x | x | x | | |
| 28 | | | | | x | x |
| 29 | x | x | x | x | | |
| 30 | x | x | x | x | x | x |
| 31 | x | x | x | x | x | x |
| 32 | x | x | x | x | | |

-continued

CONSTRUCTION PROCEDURE TABLE

| | PRIOR ART SECTION | | NEW SECTION WITHOUT UTILITY CHAMBER | | NEW SECTION WITH UTILITY CHAMBER | |
|---|---|---|---|---|---|---|
| | Col. A | Col. B | Col. C | Col. D | Col. E | Col. F |
| | Above Ground Water | Below Ground Water | Above Ground Water | Below Ground Water | Above Ground Water | Below Ground Water |
| 33 | x | x | x | x | x | x |

STEPS FOR CONSTRUCTION PROCEDURE TABLE

1. Break holes in pavement.
2. Drive soldier beams.
3. Erect forms, pour utility chamber concrete side walls, apply waterproofing (included in steps A-K).
4. Erect forms and pour protective concrete (included in steps A-K).
5. Relocate sewers and gas lines exterior to subway site (included in steps A-K).
6. Excavate between soldier beams to uncover utilities (included in steps A-K).
7. Install decking beams and decking (included in steps A-K).
8. Suspend utilities from decking beams (included in steps A-K).
9. Excavate to subgrade.
10. Pour invert protection concrete.
11. Apply waterproofing.
12. Pour invert concrete and toe bench.
13. Erect steel bents.
14. Pour invert concrete.
15. Erect precast concrete structure.
16. Pour protection concrete to top of duct bank.
17. Apply waterproofing.
18. Lay duct banks.
19. Erect forms and pour concrete to top of duct bank.
20. Erect forms for side walls and interior wall.
21. Pour protective concrete.
22. Apply waterproofing.
23. Erect forms for side wall arches and interior wall.
24. Pour side wall concrete arches and interior wall.
25. Erect forms for roof arches.
26. Pour roof concrete arches.
27. Apply waterproofing.
28. Construct duct banks.
29. Pour protective concrete.
30. Support utilities on subway roof.
31. Sandfill in back of side wall panels, backfill over roof.
32. Construct temporary roadway.
33. Restore roadway surface.

The invention will be better understood from a consideration of the following detailed description when taken in light of the accompanying drawings (FIGS. 1–1*q* representing prior art) wherein:

FIG. 1 is a cross-sectional view of a typical prior art subway section in the earth between stations;

FIG. 1*a* is a cross-section of a subway in accordance with our prior invention with utility chamber;

FIG. 1*b* is a view in plan of the subway site showing early steps of the method;

FIG. 1*c* is a section taken along the plane A—A;

FIG. 1*d* shows the next step in the method as illustrated by viewing the subway site in plan;

FIG. 1*e* is a cross-sectional view taken along the plane B—B of FIG. 1*d;*

FIG. 1*f* shows the subway site in plan to illustrate further steps of the method;

FIG. 1*g* is a cross-sectional view taken along the plane G—G of FIG. 1*f;*

FIG. 1*h* is a further plan view of the subway site to show additional construction;

FIG. 1*i* is a sectional view taken along the plane D—D;

FIG. 1*j* is a view of the subway, in plan, nearly completed;

FIG. 1*k* is a view in section taken along the plane E—E of FIG. 1*j;*

FIG. 1L shows typical trenching with concrete decking to initiate excavation of the subway itself;

FIG. 1*m* shows the concrete decking supported by the decking beams, as seen along the plane G—G of FIG. 1*j;*

FIG. 1*n* is a detailed view of a portion of FIG. 1*m;* and,

FIG. 1*q* is a further detailed view of a portion of FIG. 1*n* taken along the plane A—A to conclude the showing of U.S. Pat. No. 3,914,946;

FIG. 2 shows the inventive panel concept of the subject invention deployed in a subway construction between stations wherein provision is not made for a utility chamber;

FIG. 2*a* is a view in side elevation of panel P-1;

FIG. 2*b* is a front view of panel P-1;

FIG. 2*c* is a top plan view of panel P-1;

FIG. 2*d* is a sectional view of panel P-1;

FIG. 2*e* is a view in side elevation of panel P-2;

FIG. 2*f* is a view in side elevation of panel P-3;

FIG. 2*g* is a view in section of panel P-3;

FIG. 2*h* is a view in side elevation of panel P-4;

FIG. 3 shows a sectional view of subway construction between stations with provision for utility chamber;

FIG. 3*a* is a view in side elevation of panel P-5;

FIG. 3*b* is a view in side elevation of panel P-6;

FIG. 4 is an enlarged view of a junction between a soldier beam and a decking beam;

FIG. 4*a* is a sectional view of the structure of FIG. 4;

FIG. 5 is a sectional view of a typical prior art subway in earth at stations;

FIG. 5*a* is a sectional view of a typical prior art subway in earth at station approaches;

FIG. 6 is a sectional view of the embodiment with utility chamber at a station;

FIG. 6*a* is a side view of panel P-7;

FIG. 6*b* is a front view of panel P-7;

FIG. 6*c* is a side view of panel P-8;

FIG. 6*d* is a front view of panel P-9;

FIG. 6*e* is a side view of panel P-9;

FIG. 6*f* is a side view of panel P-10;

FIG. 6*g* is a side view of panel P-11;

FIG. 6*h* is a side view of panel P-12;

FIG. 6*i* is a sectional view of panel P-12;

FIG. 6*j* is a side view of panel P-13; and,

FIG. 6*k* is a view of the embodiment with utility chamber between stations completed.

DETAILED DESCRIPTION OF PRIOR ART

Figure 1:
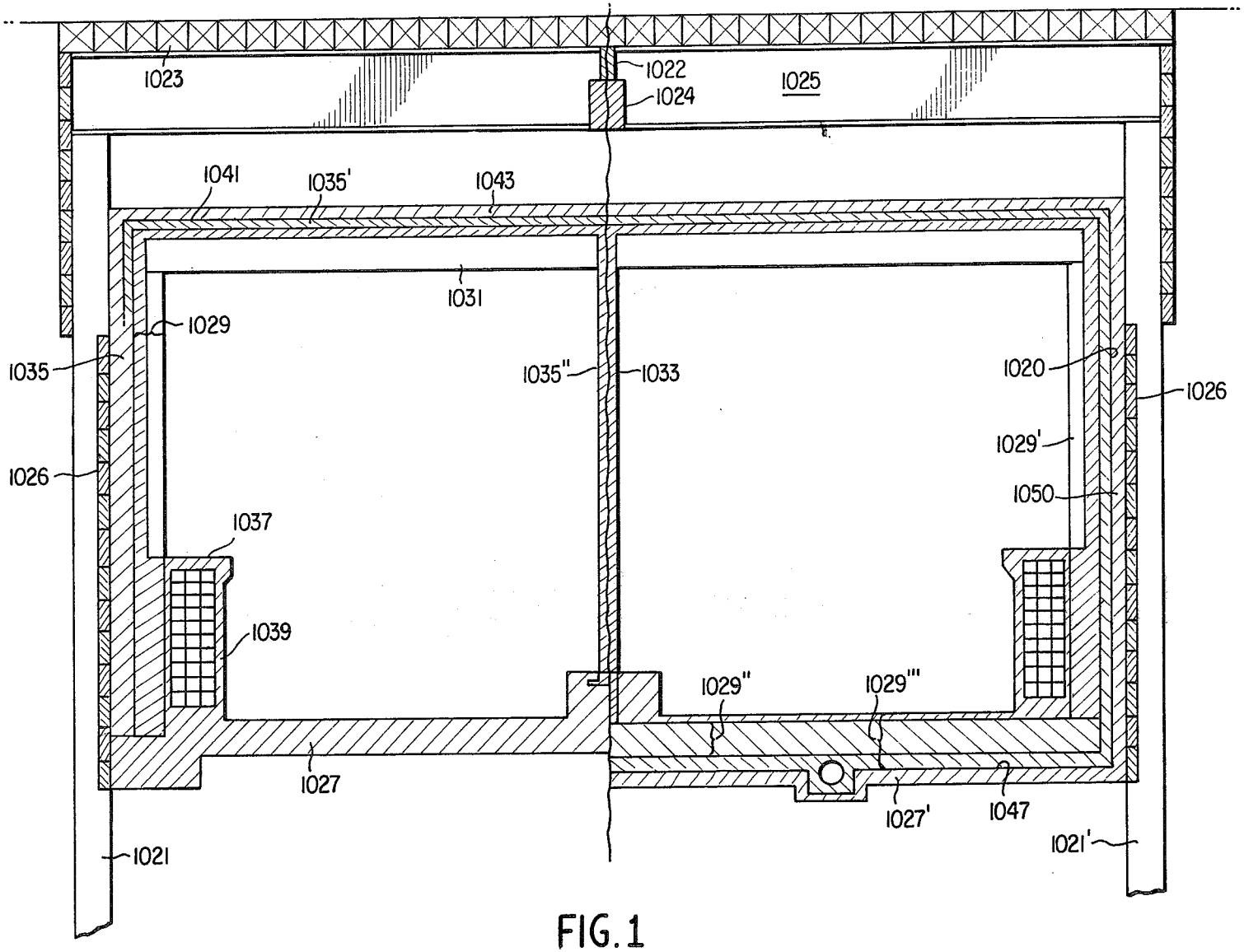

FIG. 1 is a typical two-track structure showing the current construction above and below ground water level. This typical subway section is prior art without utility chamber.

It shows a subway constructed in accordance with current methods wherein no precast or prestressed concrete sections are employed but rather each portion is tediously, progressively fabricated in tailor-made fashion.

In constructing the subway of FIG. 1, the pavement is broken, and soldier beams, such as 1021 and 1021', are driven to a depth below the invert or subgrade level. Typical 12 × 12 inches timbers 1023 provide a road surface during the period of construction. These are supported by decking beams 1025, separated by 6 × 8 inches timber top flange bracing 1022 resting on timber blocks 1024. The decking beams 1025 and construction road surface are eventually replaced with backfill and a finished roadway surface. This process requires some 6 months for the backfill to settle to receive the final surfacing.

Each contract may require three to three and one-half years to hand make the contracted subway section of FIG. 1.

After the soldier beams 1021, 1021' are driven, the earth between is excavated to accommodate the decking beams 1025 and to expose subsurface structures (utilities). The subsurface utilities are then suspended from the decking beams 1025. The decking beams 1025 support the construction roadway which is usually the timbers 1023. As the excavation proceeds, timber lagging 1026 is placed between adjacent soldier beams on each side and the excavation continues to the subgrade of the structure.

First, constructing the structure above ground water (left side of FIG. 1), the invert concrete 1027 is poured. Structural steel bents 1029, bents 1031, and columns or bents 1033 are then erected for the side wall, roof and intermediate wall. The bents are spaced on 5-foot centers. Erection of the structural framing then permits pouring of further concrete 1035, but first the duct bank 1037 is laid and then a form is built to permit pouring concrete 1039 around the duct bank. Then, the concrete arches 1035 are poured in the side walls and across the roof (1035') and the interior walls (1035''). Next, waterproofing 1041 is applied and then covered with protection concrete 1043. Now that the roof of the subway is complete, the suspended utilities may be permanently located thereon and the area backfilled from concrete 1043 to street level to begin the completion of the temporary roadway surface, which is replaced with the permanent roadway surface after settlement.

Normally, when ground water is encountered (right side of FIG. 1), the excavation is made deeper and the invert protection concrete 1027' is poured to a depth of 6 inches, on which waterproofing 1047 is applied. Steel invert beams 1029'' are placed and concrete invert 1029'' is poured. Protection concrete 1050 is poured against lagging 1026 and then waterproofing 1020 is applied over the protection concrete 1050. The same type construction proceeds using the steel bents 1029' for the right-hand side walls and the concrete previously described.

Figure 1A:
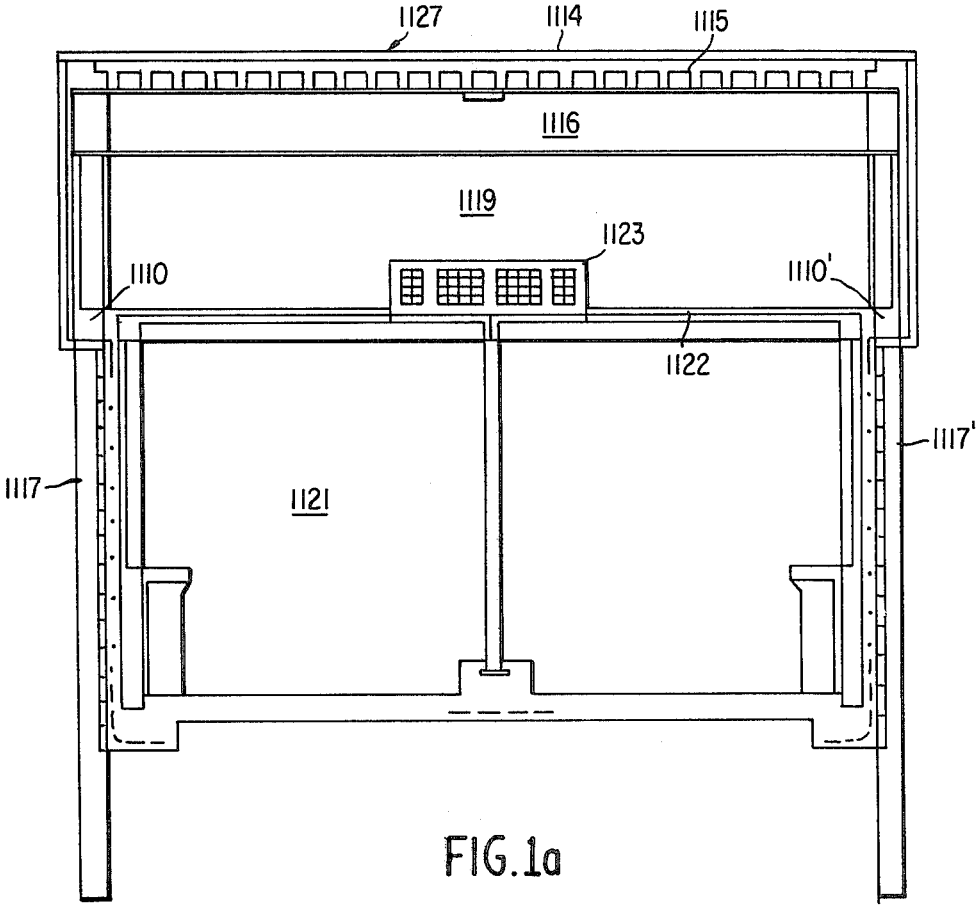
Figure 1B:
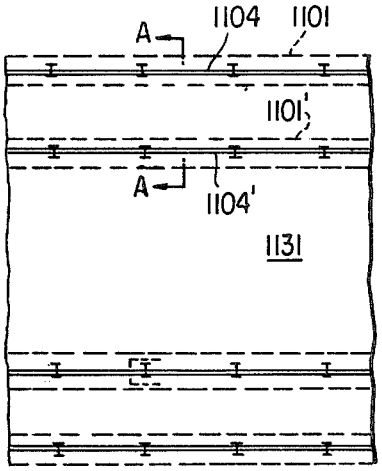

In contrast, in FIG. 1*a* of our patented invention, although the tunnel is only 28 feet 0 inches deep, for example, it includes a large utility space 1119, above the train tunnel 1121. Also, grating 1122 may be seen in the floor separating these two chambers. Subway ducts 1123 are included in the utility chamber 1119. The utility chamber is the region which provides the non-operating income and may also serve as a large air conditioning duct. The main lateral supports for the street itself, generally shown at 1127, are the decking beams 1116, in turn supporting the concrete decking 1115, which carry the asphalt or other coating 1114. The so-called further soldier beams 1117 and 1117' are seen at the sides of the excavation for tunnel 1121, with the poured concrete walls 1110 and 1110' defining the outer walls of the utility chamber 1119. Also, as can be seen, these concrete walls and soldier beams 1110 and 1110' support decking beams 1116.

To proceed with the construction, it may be seen that the plan views of FIGS. 1*b*, 1*d*, 1*f*, 1*h* and 1*j* are above the cross-sectional views extracted therefrom as seen in FIGS. 1*c*, 1*e*, 1*g*, 1*i* and 1*k*. Thus, in FIG. 1*b*, the outline of subway excavation 1131 is wider than the completed subway.

A plurality of pits or, alternatively, two pairs of trenches, such as tenches 1101 and 1101', are first dug to a level of something over 2 feet longitudinally of the site 1131. Trench 1101 is exterior of the location of the final wall of the subway and trench 1101' is interior thereof. In any event, these trenches can be covered with steel plates to permit normal traffic to resume and facilitate ready removal for driving soldier beams and further at the proper time. The trenches or pits accommodate lines of soldier beams, such as 1102 and 1102', to be driven to, for example, a depth of 18 feet to form the walls for further excavation, using the timber lagging 1104 and 1104' being placed as the excavation proceeds.

Figure 1D:
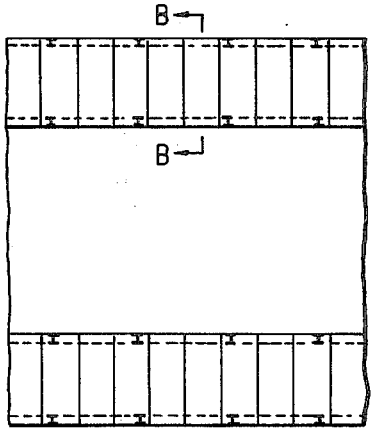
Figure 1F:
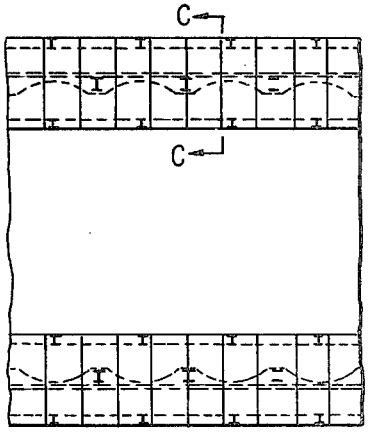
Figure 1C:
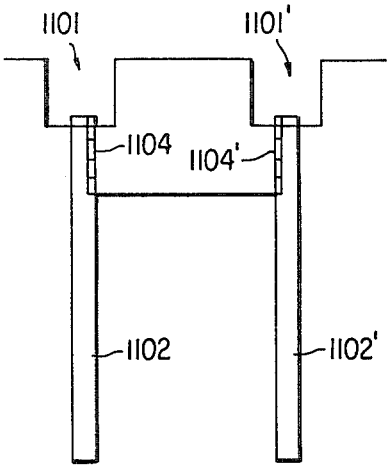
Figure 1E:
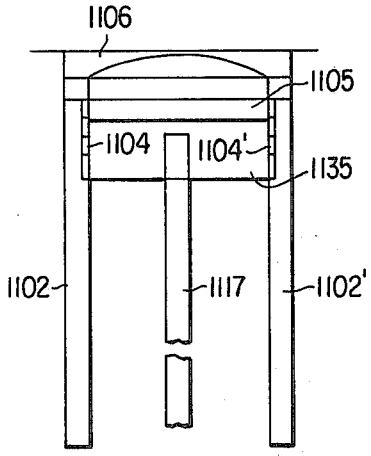
Figure 1G:
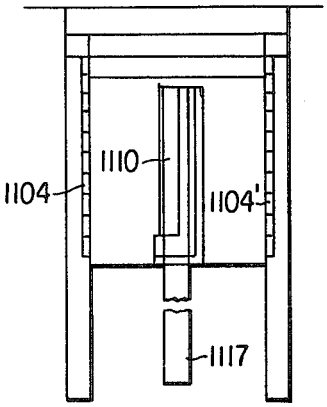
Figure 1H:
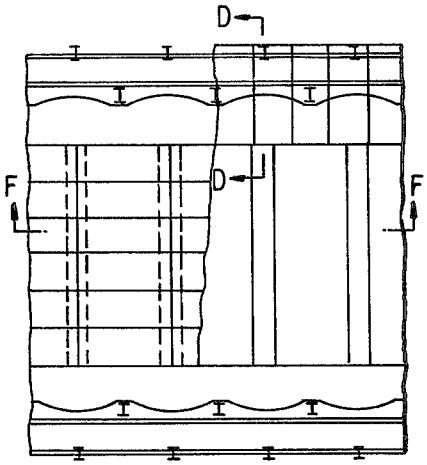
Figure 1J:
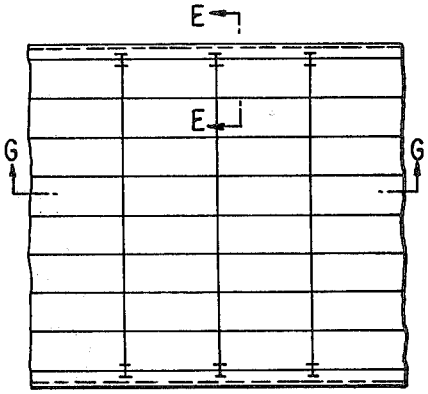

Next, FIGS. 1d and 1e illustrate the beginning step in forming the site 1131 of train tunnel 1121. Excavation has intermittently continued forming trenches, such as 1135, which is covered by timber bracing and caps 1105, supported on top of the original soldier beams 1102 and 1102' or the timer lagging 1104 and 1104' extending therebetween and the timber caps 1105, in turn support precast decking 1106. This decking may be removed to drive the further soldier beams 1117 down below subgrade of the subway structure.

Next, a concrete wall 1110 (FIG. 1g) is poured using the soldier beams 1117 as a member therefor to comprise the outer walls 1110 and 1110' of utility chamber 1119. Also, in FIG. 1*g*, it may be seen that excavation had first proceeded to the −11.6 foot level and further timber lagging 1104 and 1104' added to contain the earth.

Figure 1I:
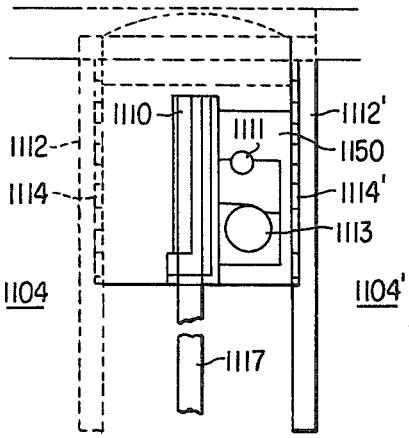
Figure 1K:
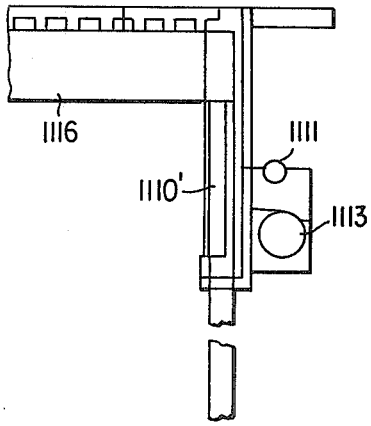

FIG. 1*i* shows the addition of gas mains 1111 and sewer main 1113 and backfill 1150 to one side or both sides of the wall 1110 to permit the removal of the concrete decking, and the timber bracing and caps. If the sewer and gas mains are placed exteriorly of wall 1110, it is much easier to connect them to dwellings or buildings because it is then not necessary to break through the wall 1110 or surface right-of-way.

Soldier beams 1102 and 1102' are also removed along with lagging 1104 and 1104' to leave only the further soldier beams 1117 and concrete wall 1110 with sewer and gas mains. The excavated space exterior to wall 1110 is then backfilled and covered with temporary pavement.

Figure 1L:
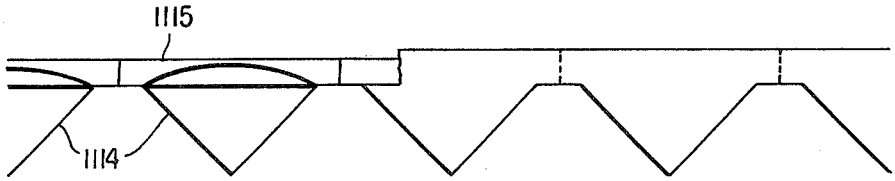
Figure 1M:
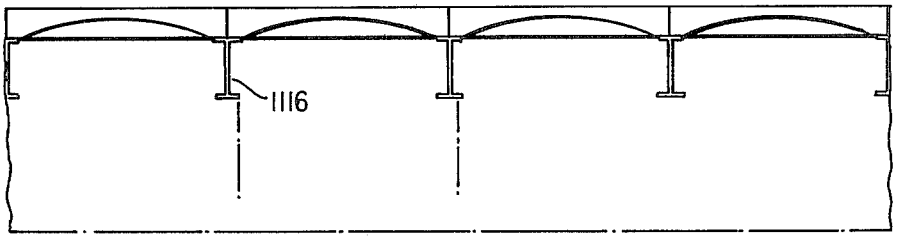
Figure 1N:
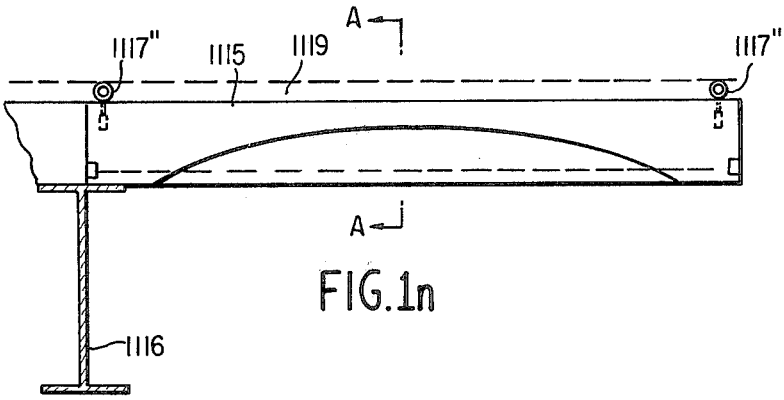

Next, the trenches 1114 (FIG. 1L) are dug laterally of the street between the concrete walls 1110 and 1110' of FIG. 1*a* to permit laying of the decking beams 1116 as supported by the soldier beams 1117 and 1117'. The trenches 1114 can be covered with concrete decking 1115 to permit normal travel and then selectively removed for installing decking beams 1116 (FIG. 1*m*) and for further excavation. For this purpose, lifting rings 1117'' are provided (See FIG. 1*n*).

The next step is to excavate down to the 10 foot 0 inch ± level to form the utility chamber 1119.

The utilities are temporarily supported from the decking steel beams 1116 in the utility chamber 1119 and so do not interfere with further excavation of the subway tunnel 1121.

Sections of the precast concrete decking 1115 may be removed when traffic conditions permit to remove excavated materials and supply items needed for construction.

The asphalt roadway 1114 is finished over the concrete decking 1115 when the decking has been finally installed upon completion of the subway structure.

Figure 1Q:
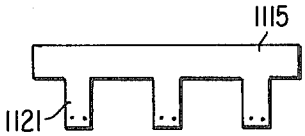

In FIG. 1*q*, the decking is shown with the ribs 1121 which contain two seven wire steel strands prestressing the 5,000 pounds per square inch concrete.

It may now be appreciated why the 6 foot minimum clearance utility chamber is significant to permit workmen to service 30 or 40 different types of utility facilities through a single manhole in the middle of each block instead of the many manholes now needed. Since ventilation of the utility chamber is constantly provided, there is no need for pumping air through individual manholes.

Annually recurring non-operating income derived from rentals to be paid by the utility companies greatly reduces the financial burdens to cities now wishing to install subway systems and permits the cities either to pay back part of the funds granted to Urban Mass Transportation Administration of the Department of Transportation or aid them in meeting operating deficits. The life of subways is estimated to be not less than 100 years.

DETAILED DESCRIPTION OF PRESENT INVENTION

Figure 2:
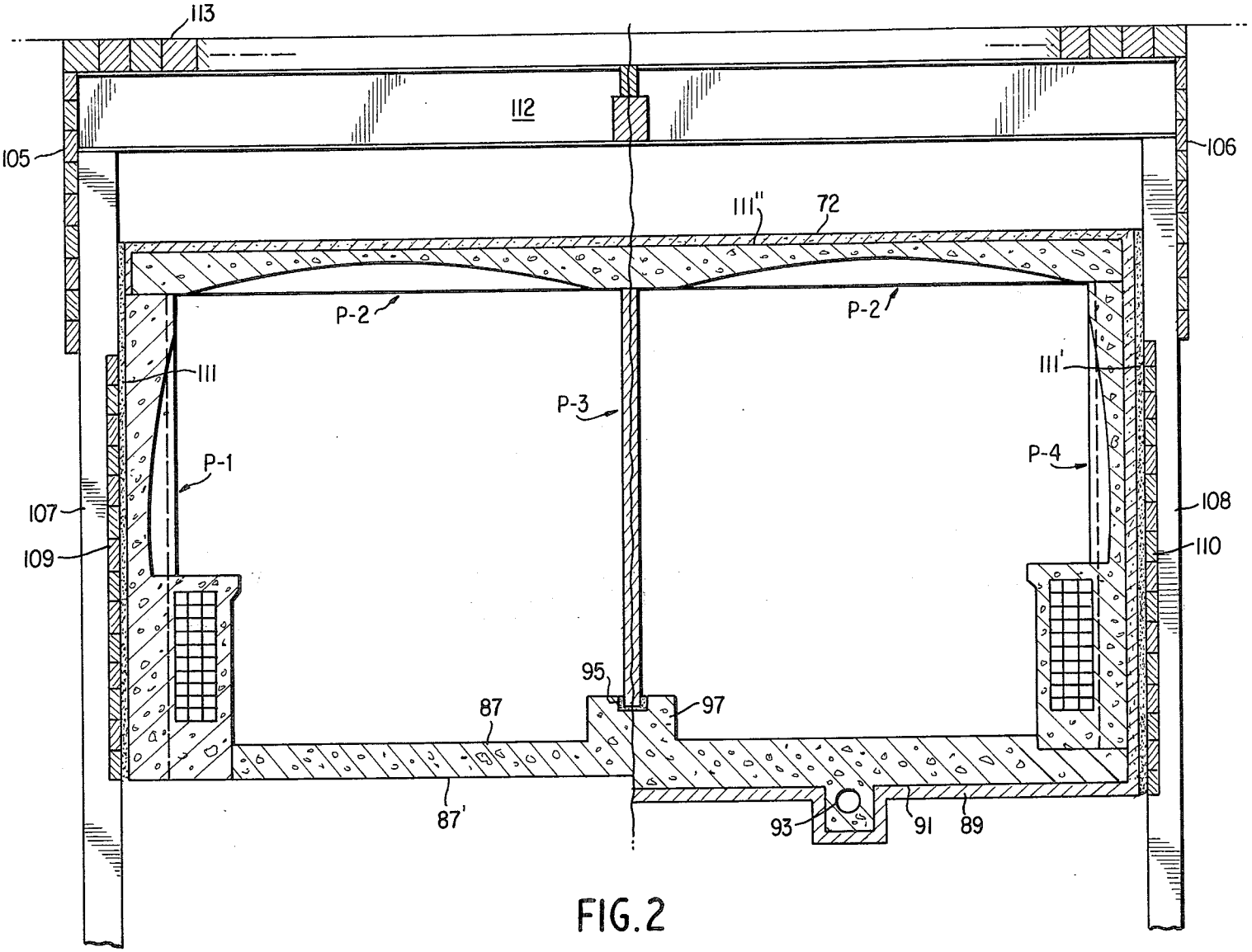

The novel subway section of FIG. 2 utilizes precast, prestressed, ribbed arch concrete panels, but does not include a utility chamber.

Figure 3:
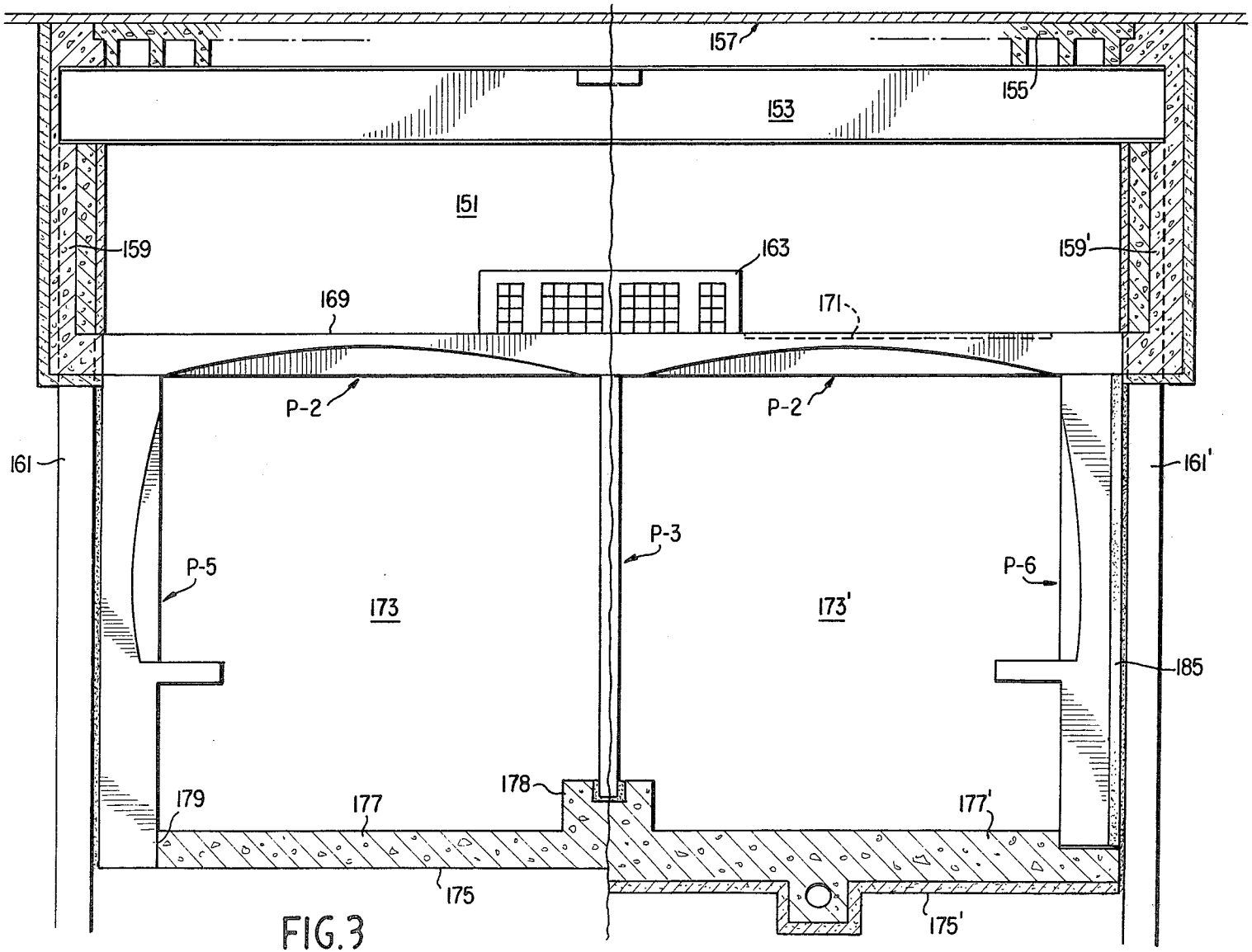

The alternate novel subway section of FIG. 3 utilizes the similar type precast, prestressed, ribbed arch concrete panels and provides for a utility chamber.

FIG. 2 shows the present invention wherein the subway may be constructed at cost savings of more than 3 million dollars per mile for a two-track subway, in approximately one-third of the time required for conventional subways, and it eliminates all structural framing, most carpenter work and substantially all but the invert in concrete pouring. Precast, prestressed, ribbed arch concrete panels P-1, P-2, P-3 and P-4 are fabricated in concrete yards for instant use in the continuous fabrication of the subway. These panels comprise side walls, the roof and intermediate walls. The side panels P-1 and P-4 also may include clay or polyurethane ducts 50 precast therein. The panels are preferably all arches including high strength wire strands in the ribbed arch and all are prestressed and precast.

Figure 2A:
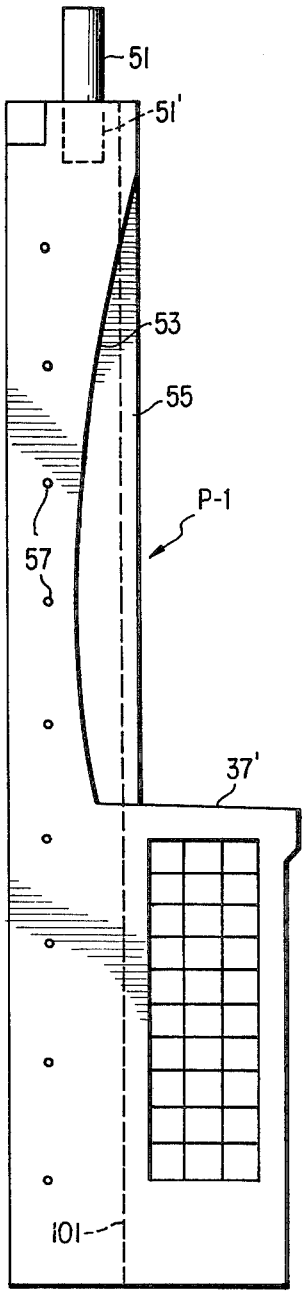

The side panels P-1 of FIG. 2*a* include a protruding steel pipe 51, precast in the panel for engagement with the roof panels P-2. These pipes serve as a means for proper alignment and grade.

Figure 2B:
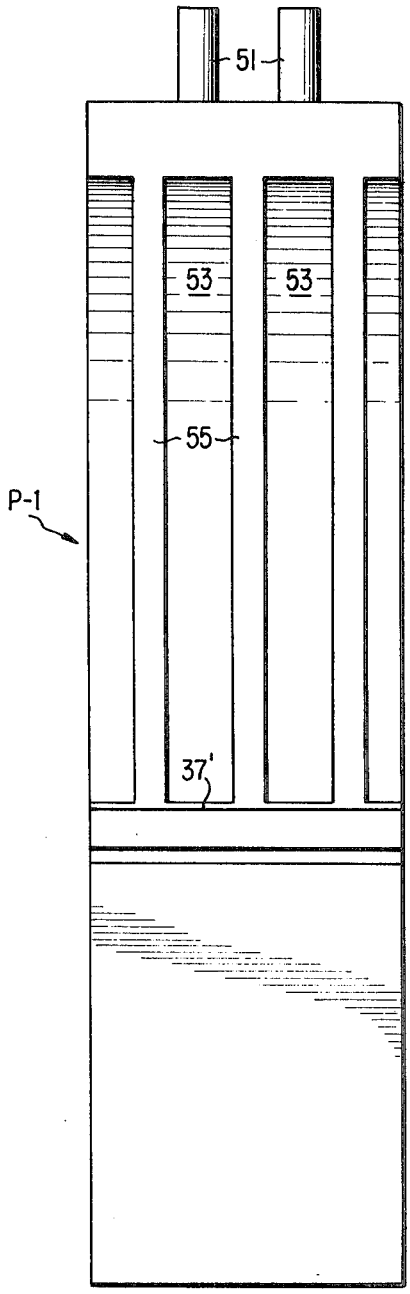

In FIGS. 2*a* and 2*b*, a typical panel P-1 is shown in side elevation and in front elevation including the duct bank 37' precast with this ribbed arch, prestressed configuration, the arches 53 and ribs 55 being clearly shown in these views. Also, temperature rods, to prevent cracking, are shown at spaced apart positions, as 57. The pipe 51, precast at 51' into panel P-1, is to be inserted into the panel P-2. It may comprise 5 inch diameter by 0.355 pound pipe. The temperature reinforcing bars 57 may comprise No. 6 bars on 1 foot, 6 inch centers. Typically, the width of panel P-1 is 4 feet and its height is 15 feet, 5 inches.

Figure 2C:
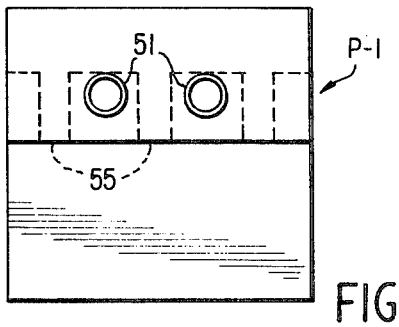
Figure 2D:
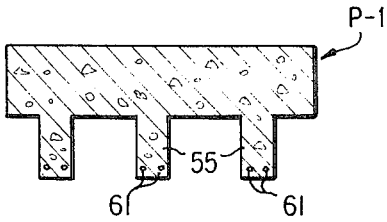
Figure 2E:
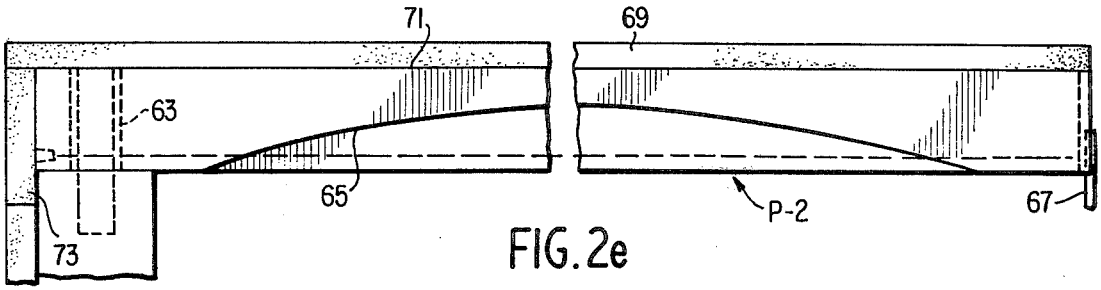

FIGS. 2*c*, 2*d* and 2*e* show further details of the panel P-1. For example, in FIG. 2*c* it is seen that a single panel preferably includes two pipes 51. From FIG. 2*d*, it will be seen that two 7-wire steel strands 61 extend longitudinally of each rib 55. The ribs may measure 5 inches in thickness with an 11 inch spacing therebetween.

The roof panel P-2 (FIG. 2*e*) includes an oversized hole 63 to receive the pipe 51, and once the panels are aligned, as by shimming or wedging, grout is placed in the oversized hole and fills the pipe to maintain the alignment. The roofing panels also include ribbed arches 65 and a 2 inch rod 67 for engagement with the intermediate panels P-3 (FIG. 2*f*) which, after alignment, is grouted in place. Protection concrete 69 covers the waterproofing 71 to complete the roof precast panels. After the roof is waterproofed and protected by some 4 inches of poured-in-place concrete 72 over waterproofing 111'' (FIG. 2), backfill is placed and tamped, the roadway is then finished off in the manner previously described, i.e., with the utilities being supported on the roof.

Roofing panel P-2 preferably measures 15 feet, 8 inches in length, 4 feet in width and 1 foot, 2 inches in thickness. In finally assemblying panel P-2 to panel P-1, bituminous concrete or asphaltic seal, shown at 73 in FIG. 2*e*, is used to fill in the exterior corners of the construction of FIG. 2. The waterproofing 71 is preferably three-ply and the protection concrete 69 is 4 inches in thickness.

Figure 2F:
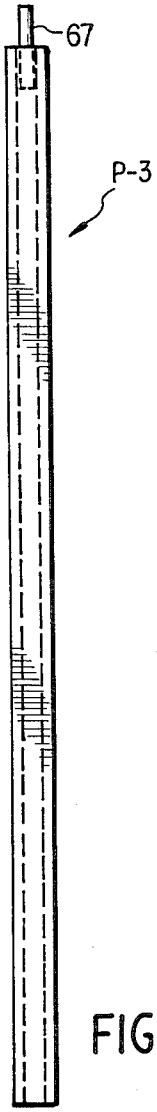
Figure 2G:
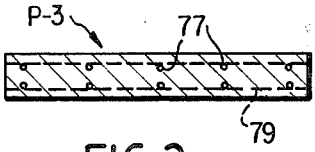
Figure 2H:
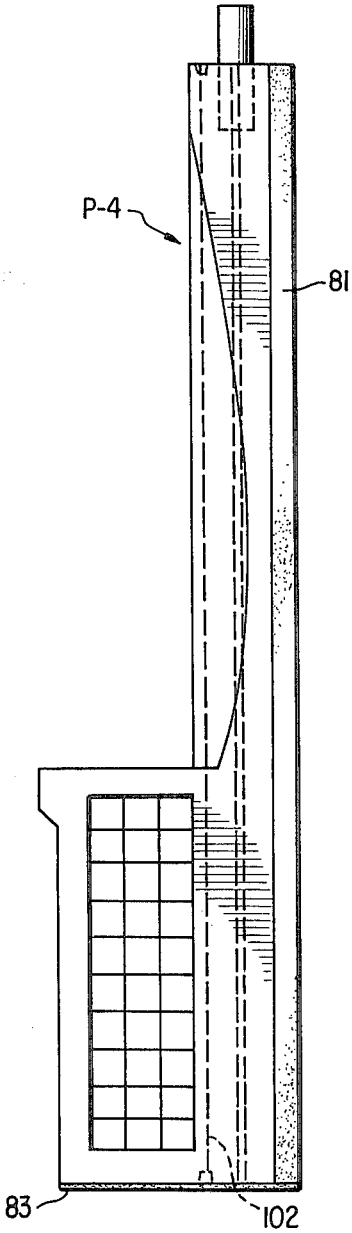

The intermediate panels P-3 are illustrated in FIG. 2*f*, with a section being shown in FIG. 2*g*. The thickness of these panels is preferably 6 inches and the height 13 feet, 8 inches with the 2-inch rod 67 extending upwardly another 6 inches. The regular reinforcing rods 77 and wire ties 79 are visible in FIG. 2*g* wherein the width of panels P-3 is 4 feet. It should be noted that panel P-4 differs from panel P-1 in that a bituminous concrete backing 81 is applied in the casting yard to the exterior side and, in cooperation with the grout 83, enables this section to be used for constructon where the subgrade is below ground water, whereas panel P-1 is designed for use above ground water level. Hence, in FIG. 2, the invert concrete is shown at 87, the left-hand side being poured on the subgrade 87′ and the right-hand side on the protection concrete 89, covered by waterproofing 91; drain 93 being plainly visible.

The intermediate panels P-3 are set in grout disposed in channel 95 in toe bench 97, and all panels P-1, P-3 and P-4 are properly located by using shims for proper alignment at the bottoms and tops thereof as required. These shims are used with the grout in such openings as 63 in panel P-2. The members 101 and 102 of panels, such as P-1 and P-4, are prestressing cables.

In constructing the subway of FIG. 2, the pavement is broken to permit driving the soldier beams 107 and 108 and lagging 105 and 106 is placed so that excavation may proceed, using the further lagging 109 and 110 to the subgrade 87′. Next, the invert concrete 87 is poured and the panels P-1 and P-4 erected. They are aligned and grouted in place, bearing in mind that the decking beams 112 had been previously located in the excavation, to extend laterally across the subway site, with the timbers 113 spanning the spaced apart decking beams to provide the construction road surface.

After all panels P-1 through P-4 have been installed and the sandfill at 111 and 111′ completed, the necessary backfill is accomplished and, subsequently, after the temporary road settles, the final road surface is applied in lieu thereof.

The additional steps required for the right-hand side typifying a below ground water condition are: pouring the invert protection concrete 89, applying the waterproofing 91, pouring the invert concrete and toe bench 97, pouring protective concrete 111′, and applying waterproofing 111″. Of course, panel P-4 includes the bituminous layer 81, applied at the casting yard; also, a layer of asphalt or bituminous concrete is installed along the edges and tops of the panels after alignment providing waterproof sealing.

In the areas where utility chambers are not required, ducts may be placed under the walk benches along the subway side walls.

For the purpose of pulling cables, manhole structures are necessary. They are constructed on each side of the subway about 300 feet apart. The manholes are approximately 22 feet long by 6 feet wide with manhole chimneys extending upwardly, exteriorly of the subway walls.

FIG. 3 shows a modification of the present invention to incorporate a utility chamber in a subway constructed from precast, prestressed, ribbed arch concrete panels. The subway improves over that of our U.S. Pat. No. 3,914,946 which incorporates a utility chamber after which the subject utility chamber is patterned.

The structure and method of constructing utility chamber 151 of FIG. 3 is identical to that explained in connection with FIG. 1*a* and the subsequent figures, taken from our patent, for utility space 1119. This method accommodates the cut and cover principle to avoid traffic interruption. The decking beams 153 support the concrete decking 155 in turn carrying the finished road surface 157. The poured concrete side walls 159 and 159′ encase the upper portion of soldier beams 161 and 161′ and bound the utility chamber. Also, the duct bank 163 is shown resting on the panels P-2 forming the roof 169 of the subway. Grating 171 may be employed in this roof as required.

Figure 3A:
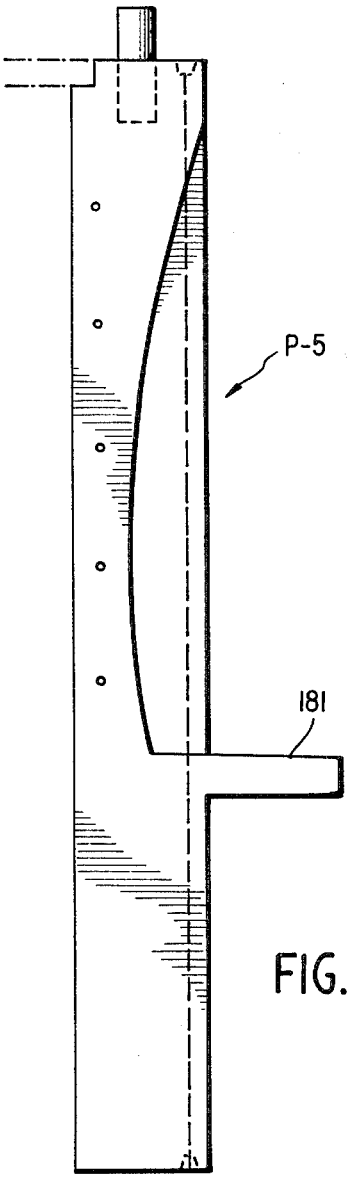
Figure 3B:
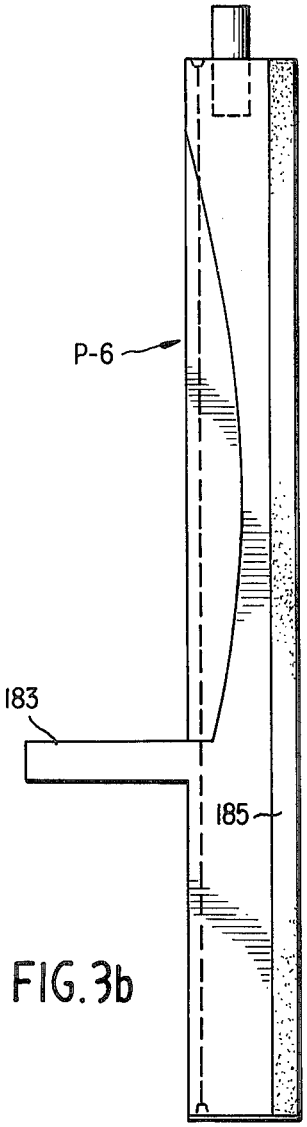

However, before forming the roof 169 to support the duct bank 163, the present invention differs from our patent in that the train tunnels 173 and 173′ are formed from precast, prestressed, ribbed arch concrete panels. First, excavation proceeds to the subgrade level (shown to the left at 175 and to the right at 175′). The invert concrete 177 is poured on the left-hand side, forming also the toe bench 178 but terminating against panel P-5 at edge 179. This construction prevents panel P-5 from being displaced inwardly. Thus, it may be seen from a comparison of FIGS. 3*a* and 3*b* that panel P-5 is slightly longer (approximately 6 inches) from its bottom edge to the top of its walk bench 181, relative to panel P-6, so that its walk bench 183 will be at the same level. The top of these walk benches is 4 feet above the base of the rail.

The panels P-5 and P-6 are installed in the same manner previously explained and are otherwise constructed as described in connection with the other side panels, panel P-6 including the bituminous concrete backing 185 and being seated approximately 6 inches into the invert concrete 177′ or to have a 5 inch diameter pipe embedded in the bottom of the panel similar to that shown in FIG. 2*a* at 51. The intermediate panels P-3 and roof panels P-2 are of the same construction heretofore described, thereby effecting substantial savings in the construction of a train tunnel with utility chamber.

The duct bank 163 includes removable steel panels, about 300 feet apart, forming access service manholes for pulling cables and entering cables into the subway.

Entry of cables into the service manholes is made through manholes located midway between cross streets for use in common for all utilities.

Locating duct bank 163 in utility chamber 151 eliminates the need for duct manholes with chimneys to the street surface on each side of the subway — generally spaced about 300 feet apart. This eliminates many short circuits, explosions, and attendant smoky fires in the subway. Salt, dumped on street ice or snow, combines with water to seep into manholes and corrodes cables. Exposed wires spark and ignite accummulated gases. As many as twenty calls a day are received by Con Edison on winter thaw out days but very few calls are received in the summertime.

Figure 4:
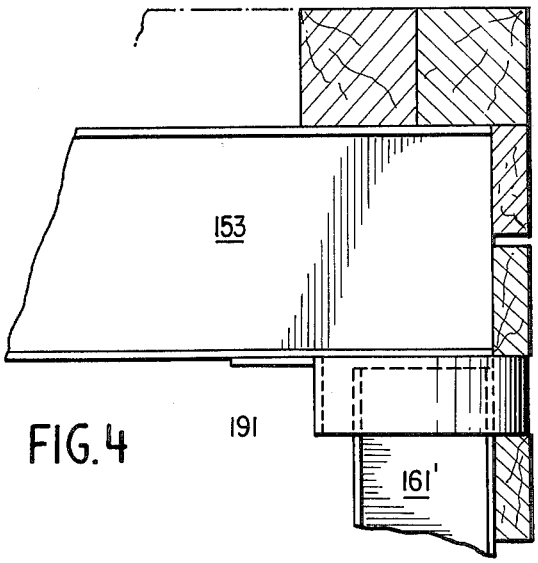
Figure 4A:
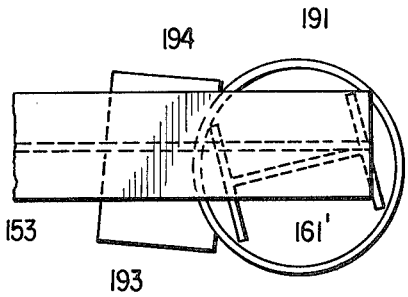

A feature of the invention resides in the structure for and method of supporting the decking beams 153 (FIGS. 4 and 4*a*) from soldier beams such as 161' to accommodate transverse, lateral, vertical and tractive forces, the latter being occasioned by changing speeds of vehicles passing over the roadway surface. The soldier beams 161' are burned off slightly below the required height for supporting the beams 153. Then, a relatively loose pipe or collar 191 is placed about soldier beam 161' and adjusted to the proper elevation to support the decking beam 153. A wooden form or the like is provided to close its bottom as by clamping about beam 161' beneath collar 191 or to the collar itself. Then, concrete is poured into the top of the collar 191 to fill it, and finally, a plate 193 is welded to the lower surface of decking beam 153 at weld lines 194, being contoured to fit against a substantial arc of pipe 191. In this manner, the forces of the earth tending to move soldier beam 191' inwardly are counteracted by plate 193 and the opposite structure on the other side, whereas the beam 153 and pipe 191 are held against lateral and longitudinal movements due to the curvature of plate 193 and the pipe 191, through the poured concrete, transfers the vertical load to the soldier beam 161'.

It is estimated that the use of the present invention will result in a cost saving for constructing a two-track subway in New York City will approximate $3,600,000 and elsewhere an average of $3,000,000 per mile.

Figure 5:
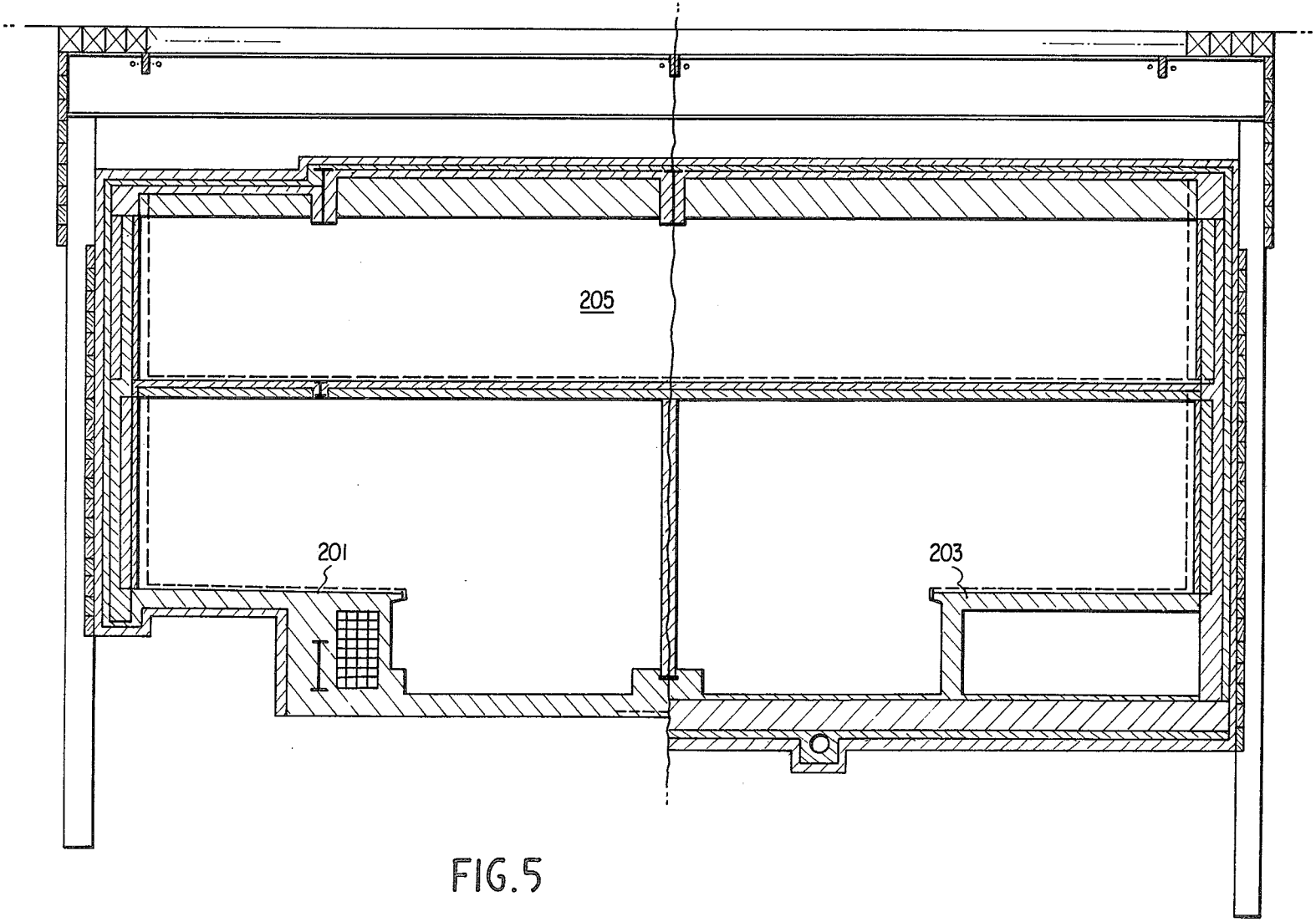

FIG. 5 shows a conventional two-track station, without utility chamber, wherein the large platforms 201 and 203 are provided for accommodating the passengers, and the mezzanine area 205 is required for the turnstiles, passage from the street to the train, stairways and the like. The tailor-made, tedious type construction of this station should now be apparent from the previous descriptions, and this figure is presented for comparison with FIG. 6, showing the invention with utility chamber at a station.

Figure 6:
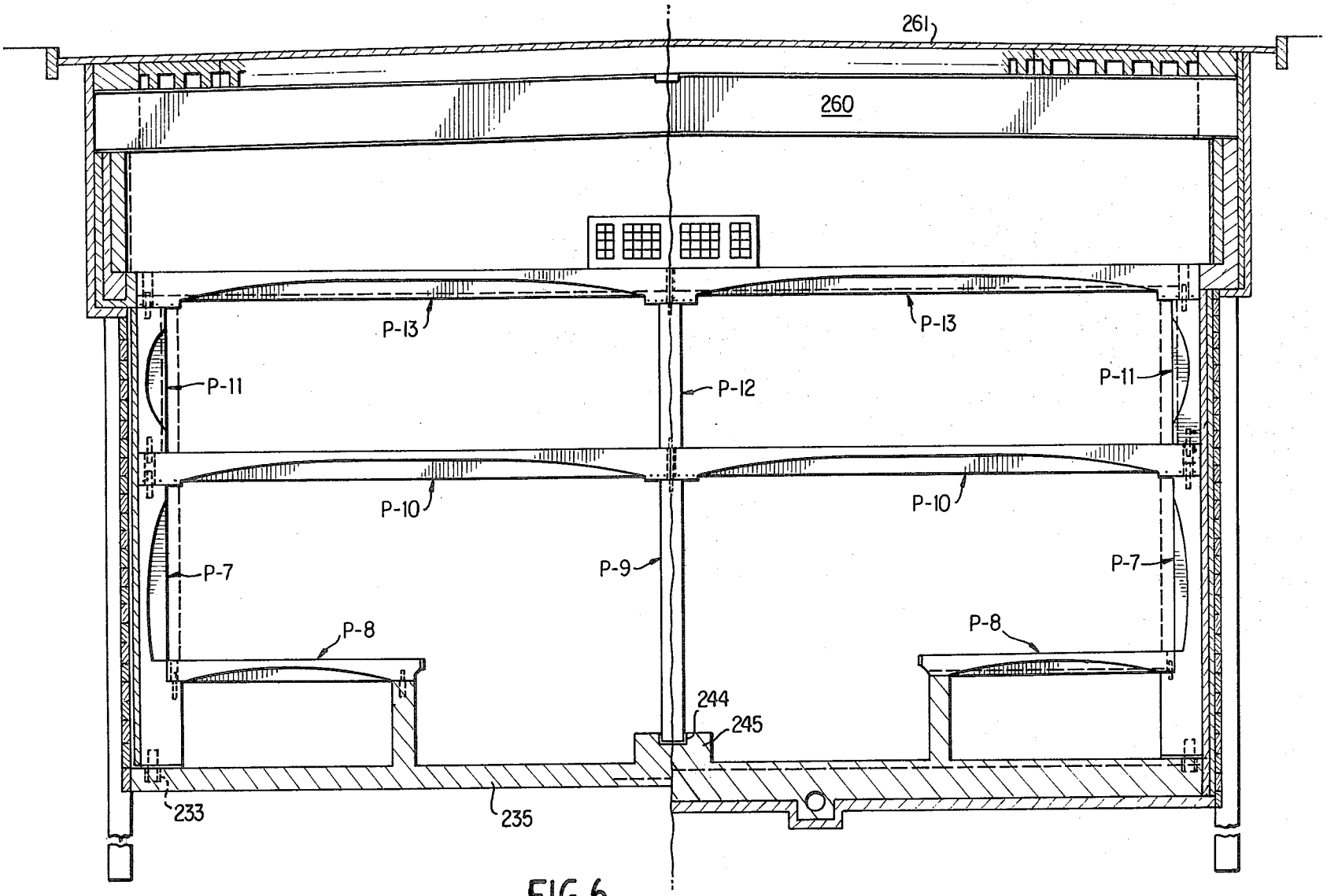
Figure 6A:
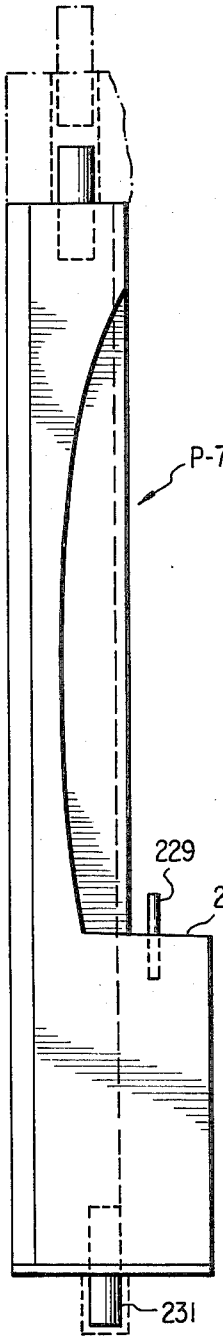
Figure 6B:
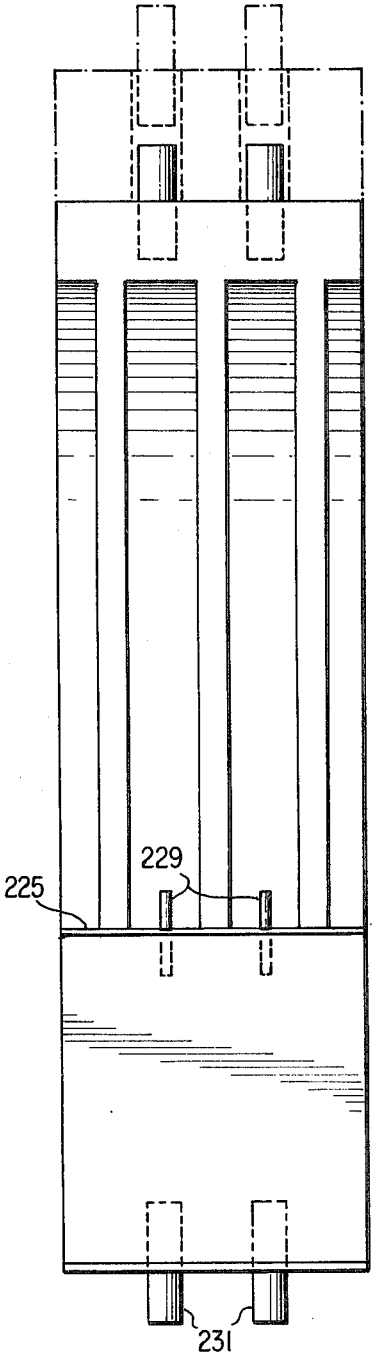
Figure 6C:
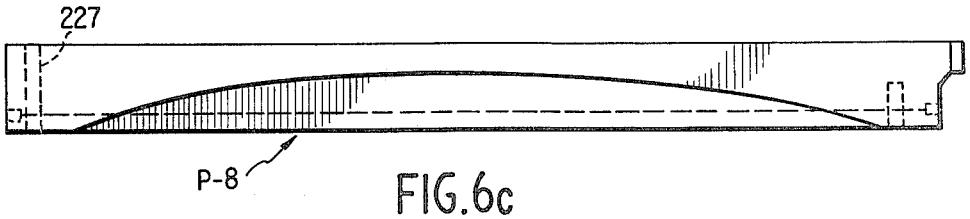

In FIG. 6, several new panel configurations are presented, from panel P-7 through panel P-13. Reference to FIG. 6a shows panel P-7 for the lower side wall wherein a horizontal surface 225 is provided for receiving panel P-8 of FIG. 6*c* with the grout holes 227 thereof receiving the 2-inch rods 229 of panel P-7 for each section. Also, panel P-7 includes a depending pipe 231 for grouting in a loose orifice 233 in the invert concrete 235. This latter construction may be used with panels P-1, P-4 and P-6.

The unique feature of the panels herein depicted is the structure that permits all panels to lock above and below to the adjacent structure thereby insuring rigidity of this deep construction.

Figure 6D:
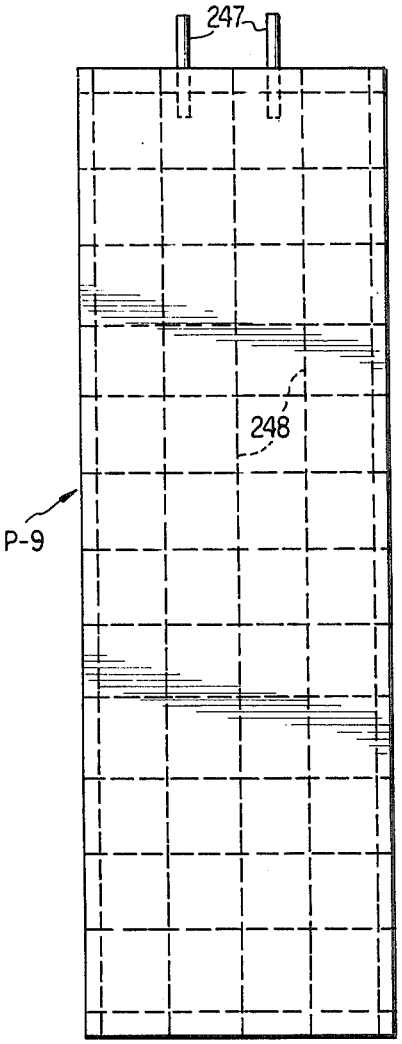
Figure 6E:
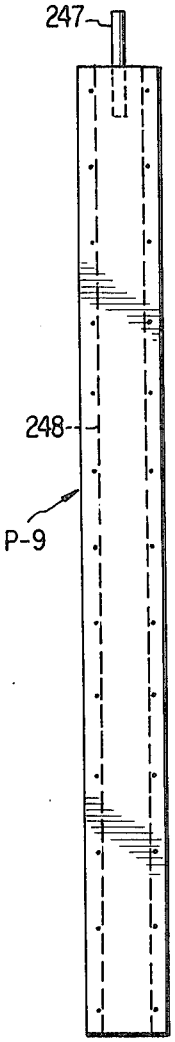
Figure 6G:
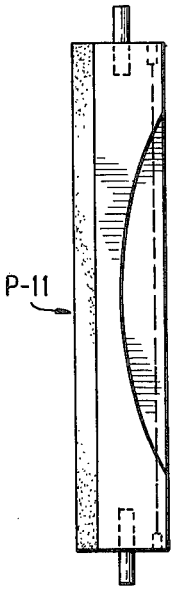
Figure 6H:
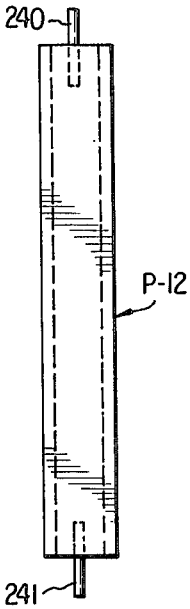
Figure 6I:
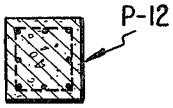

At the station of FIG. 6, the mezzanine employs the columns P-12 of FIGS. 6*h* and 6*i* in order that intermediate clear spaces may be provided for passenger traffic. These columns are preferably square and spaced 12 feet apart on centers. They also include the upper and lower rods 240 and 241 for interconnection to adjacent panels.

Panels P-9 of FIGS. 6*d* and 6*e* include reinforcing rods 248 and may be 4 feet in width and spaced apart 16 feet on centers in the train tunnel. Their lower ends are received in recess 244 in toe bench 245 and their upper ends include the 2-inch bars 247 for attachment to roof panels P-10.

Figure 6F:
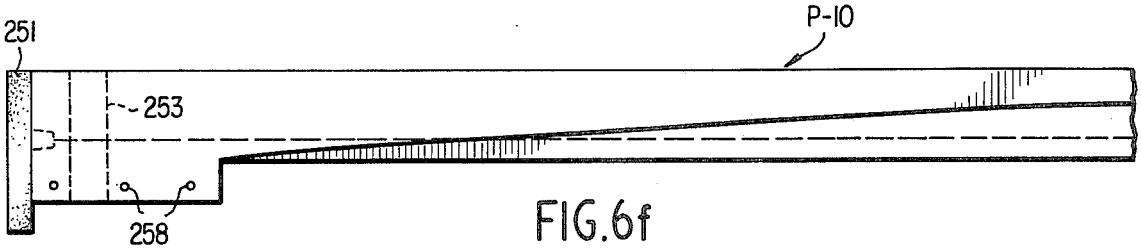

One-half of a single P-10 panel is shown in FIG. 6*f* and each included a bituminous concrete layer 251 on the ends thereof and spaced apart apertures 253 for alignment and connection purposes.

Figure 6J:
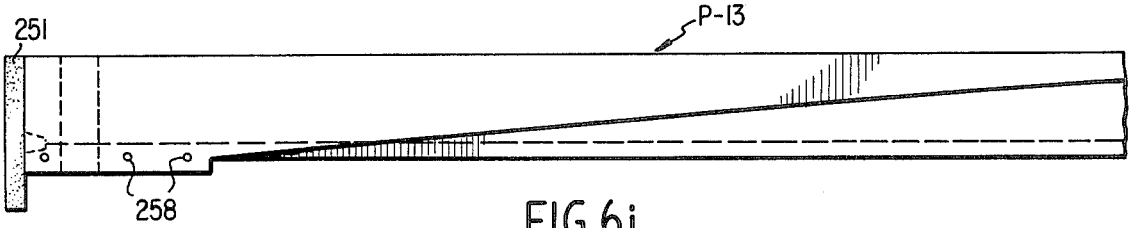

The precast concrete panels P-13 and P-10 of FIGS. 6*j* and 6*f* include post tension holes 257 and 258 for cables to extend therethrough in order that four panels may be tensioned together and erected as a unit. The decking beams 260 (FIG. 6) include a 6-inch camber, due to the long span laterally of the tunnel, to provide the necessary pitch for roadway drainage from asphalt surface 261.

Construction of the subject subway follows conventional practice in that approaches to train stations and other locations gradually increase in depth to allow for the construction of a mezzanine but the novel principal and essential configuration of the prestressed concrete panels remains the same with the exception of the height measurements. The panels P-11 of FIG. 6*g* provide the shorter side walls of the mezzanine, but otherwise are constructed the same.

Figure 6K:
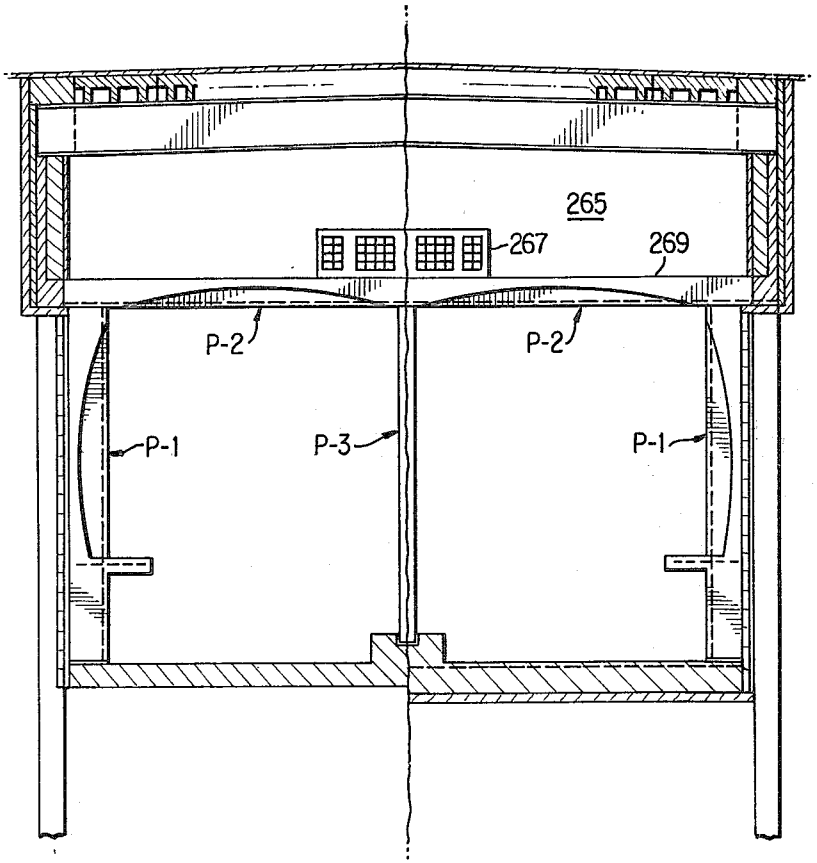
Figure 5A:
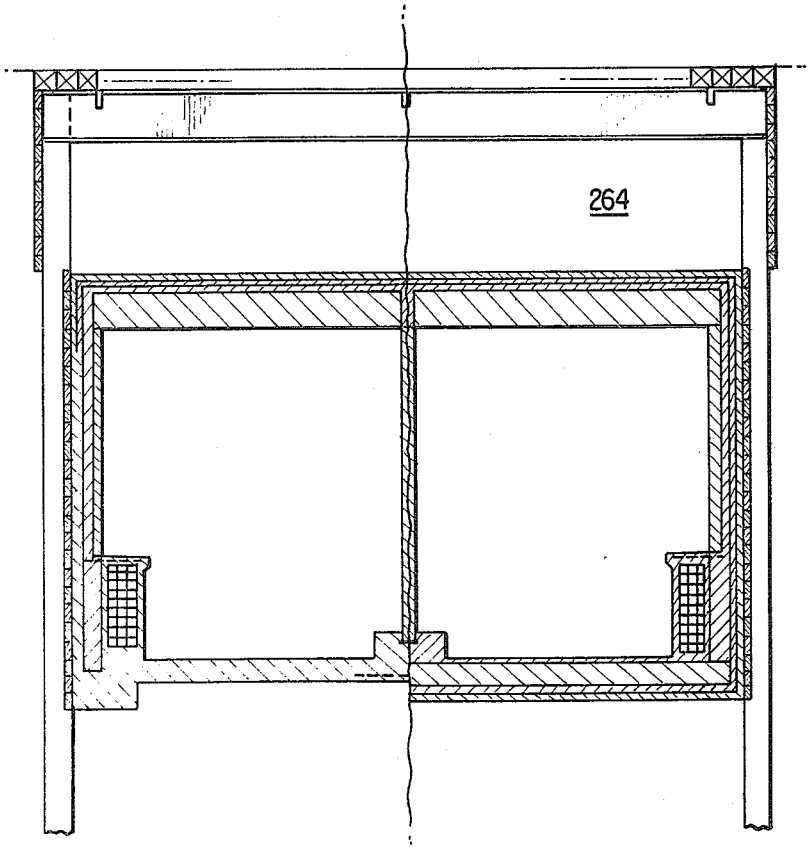

A comparison of FIGS. 5*a* and 6*k* shows the difference between a prior art tailor-made section in earth between stations relative to the inventive embodiment between stations with utility chamber, as shown in FIG. 6*k*. In FIG. 5 *a*, it is necessary to backfill at 264 and perform the same type piece-by-piece construction heretofore described, whereas in FIG. 6*k* the utility chamber 265 is provided with duct bank 267 being located on floor 269 thereof. Panels P-1 form the side walls and P-2 the roof. The intermediate wall is formed of panels P-3, and the erection and elements are as previously described.

The four-track sections have not been illustrated as they follow the principles heretofore explained. The roof panels are of the same configuration but of greater span. The decking beams frame into intermediate longitudinal girders, in turn supported by center columns of piles spaced every 20 feet in the station. In order that the center columns may be erected in proper alignment, they should be placed in holes preaugered to subgrade of the subway, and then driven, as piles, to the depth necessary to sustain the column loading. Otherwise, the only changes are in dimensions.

All the foregoing descriptions also apply, in general, to areas where the structures are partly in rock.

At approaches to stations, to lessen the blast of air caused by rapidly moving trains, precast concrete columns may be substituted for the center walls.

Where crossovers are to be installed in the trainway, these columns may be omitted and the subway roof panels increased in depth to provide the additional strength required for the longer spans.

It is estimated that the savings per mile of four-track subway construction in New York City will approximate $8,335,000 and elsewhere, averaging $6,900,000 with these figures likely being on the conservative side. Savings result from such factors as less complex engineering, simpler and quicker construction, less expensive administration of contracts (less financial and legal) and average use of funds for 6 months to 1 year rather than 1 and one-half to 3 years. Also, the subways may be readied for revenue producing much earlier and hindrance to street traffic and disruption of adjacent business is greatly reduced. The subway construction time may be reduced from approximately 3 and one-half years to 1 year. It should be recalled that immediately following pouring of invert concrete, the precast panels may be erected to form the completed subway structure ready for installation of tracks, signals, power and other equipment.

What is claimed is:

1. The method of forming a subway or an underground tunnel, in areas where ground water is not encountered, comprising the steps of:
- constructing a utility chamber by cut and cover method wherein soldier beams are driven along the outer edges of the subway to be constructed and the earth therebetween removed with concrete walls being poured to include the soldier beams and the street over the utility chamber being formed of laterally extending decking beams supported by said soldier beams, precast, prestressed, ribbed arch concrete decking supported longitudinally of the subway on said decking beams and asphalt coating said concrete decking;
- excavating to the subgrade for train tunnels beneath said utility chamber;
- pouring invert concrete on the subgrade;
- constructing side walls for said train tunnel by using precast, prestressed, ribbed arch panels incorporating duct banks therein and aligned vertically of the subgrade;
- constructing an intermediate wall utilizing different panels of precast reinforced concrete;
- constructing a roof between said side walls by utilizing further precast, prestressed, ribbed arch concrete panels extending from the side walls to the intermediate wall; and,
- constructing duct banks supporting utilities on the subway or tunnel roof and restoring the roadway.

2. The method of claim 1 in areas wherein ground water is encountered above the subgrade comprising the further steps of:
- pouring invert protection concrete; and,
- applying waterproofing.

3. The method of constructing a subway or the like without utility chamber, in areas where ground water is not encountered, comprising the following steps:
- breaking holes in the pavement;
- driving soldier beams;
- relocating sewers and gas lines exterior to subway site;
- excavating between soldier beams to uncover utilities;
- installing decking beams and decking;
- suspending utilities from decking beams;
- excavating to subgrade;
- pouring invert concrete;
- erecting precast concrete panel structure including side walls, center wall and roof;
- applying waterproofing to the roof;
- pouring protective concrete over the waterproofing;
- supporting the utilities on the subway roof;
- sandfilling in back of the side wall panels and backfilling over the roof;
- constructing a temporary roadway; and,
- restoring the roadway surface.

4. The method of constructing a subway or the like without utility chamber under a pavement wherein the subgrade is below ground water including the following steps:
- breaking holes in the pavement;
- driving soldier beams;
- relocating sewer and gas lines exterior to subway site;
- excavating between soldier beams to uncover utilities;
- installing decking beams and decking;
- suspending utilities from decking beams;
- excavating to subgrade;
- pouring invert protection concrete;
- applying waterproofing over the protection concrete;
- pouring invert concrete and toe bench;
- erecting precast concrete panel structure for subway side walls, center wall and roof;
- applying waterproofing over roof and side walls;
- pouring protective concrete over roof and side walls waterproofing;
- supporting utilities on subway roof;
- sandfilling in back of side wall panels, backfilling over roof;
- constructing temporary roadway; and,
- restoring the roadway surface.

5. The method of constructing a subway or the like with utility chamber in areas where ground water is not encountered comprising the following steps:
- forming spaced apart pits or trenches along the outer edges of the subway site which can be immediately covered with steel plates to permit normal traffic flow;
- removing the plates and locating soldier beams at spaced positions in each pit;
- excavating further and inserting timber lagging between the spaced soldier beams as excavation proceeds;
- installing timber bracing and caps across the tops of the soldier beams to receive precast decking;
- driving further soldier beams between the aforementioned soldier beams after the decking and bracing are removed;
- excavating between the further soldier beams and constructing concrete walls along said further soldier beams longitudinally to comprise the outermost edges of the subway;
- laying sewer and gas mains exterior of the concrete walls to permit ready connection to dwellings or buildings;
- trenching laterally of the subway site at spaced apart locations to receive decking beams;
- erecting the steel decking beams and placing precast, prestressed concrete decking on the decking beam supports;
- excavating to a level below all utilities;
- supporting the utilities from the decking beams by suitable hangers and cradles to form said utility chamber;
- excavating to subgrade;
- pouring invert concrete;
- erecting and finishing precast, prestressed, ribbed arch concrete structure panels for side walls, center wall and roof;
- constructing duct banks on subway roof;
- supporting utilities on subway roof;
- sandfilling in back of side wall panels; and,
- restoring roadway surface above utility chamber.

6. The method of constructing a subway or the like with utility chamber in areas where ground water is encountered wherein the subgrade is below ground water including the following steps:
- forming spaced apart pits or trenches along the outer edges of the subway site which can be immediately covered with steel plates to permit normal traffic flow;

removing the plates and locating soldier beams at spaced positions in each pit;
excavating further and inserting timber lagging between the spaced soldier beams as excavation proceeds;
installing timber bracing and caps across the tops of the soldier beams to receive precast decking;
driving further soldier beams between the aforementioned soldier beams after the decking and bracing are removed;
excavating between the further soldier beams and constructing concrete walls along said further soldier beams longitudinally to comprise the outermost edges of the subway;
laying sewer and gas mains exterior of the concrete walls to permit ready connection to dwellings or buildings;
trenching laterally of the subway site at spaced apart locations to receive decking beams;
erecting the steel decking beams and placing precast, prestressed concrete decking on the decking beam supports;
excavating to a level below all utilities;
supporting the utilities from the decking beams by suitable hangers and cradles to form the utility chamber;
excavating to subgrade;
pouring invert protection concrete;
applying waterproofing over invert protection concrete;
pouring invert concrete;
erecting precast concrete structure panels for the side walls, center wall and roof and finishing off same;
constructing duct banks on the roof;
supporting utilities on the subway roof;
sandfilling in back of side wall panels; and,
restoring the roadway surface.

7. The method of constructing a subway or the like with utility chamber beneath the city streets in areas where ground water is not encountered utilizing precast, prestressed concrete panels as elements of the structure, comprising the steps of:
trenching along the edges of the subway site;
driving soldier beams at spaced apart locations along said trenches;
excavating between spaced apart soldier beams and affixing lagging to said soldier beams to hold back the unexcavated earth;
driving further soldier beams in the excavated regions to below subgrade level;
excavating between the further soldier beams and constructing concrete walls along said further soldier beams longitudinally to comprise the outermost edges of the subway;
laying sewer and gas mains exterior of the concrete walls;
trenching laterally of the subway site at spaced apart locations to receive decking beams;
erecting the steel beams and placing precast, prestressed concrete decking on the decking beam supports;
excavating to a level below all utilities;
supporting the utilities from the decking beams by suitable hangers and cradles;
excavating to subgrade;
pouring plain concrete invert including a toe bench;
erecting side walls of precast, prestressed concrete panels including panels including safety walks;
shimming the side wall panels to line and grade;
erecting a center wall of precast, reinforced concrete panels on said toe bench;
shimming the center wall;
erecting a roof of precast, prestressed concrete panels extending between said side walls and center wall;
constructing duct banks;
supporting utilities on the roof;
sandfilling behind said side walls; and,
finishing a street over said excavation using said further soldier beams, decking beams and precast, prestressed concrete panels for support.

8. The method of claim 7 wherein said side wall panels and center wall panels have pipes embedded in their tops with projections extending upwardly and bottoms with projections extending downwardly and wherein said roof panels and invert concrete are apertured loosely to receive said pipes, the further steps of:
inserting said pipes in said apertures;
shimming the pipes in said apertures for alignment and grade purposes; and,
grouting the shimmed pipes.

9. The method of constructing a subway or the like with utility chamber beneath the city streets utilizing precast, prestressed concrete panels as elements of the structure wherein ground water is encountered, comprising the steps of:
opening the earth along the edges of the subway site;
driving soldier beams at spaced apart locations along the openings;
relocating sewer and gas lines exterior to the subway site;
excavating between spaced apart soldier beams to uncover utilities and affixing lagging to said soldier beams to hold back the unexcavated earth;
installing decking beams supported by the soldier beams and concrete decking supported by the decking beams;
suspending the uncovered utilities from the decking beams;
excavating to subgrade;
pouring invert protection concrete;
applying waterproofing over the protection concrete;
pouring invert concrete and toe bench;
erecting side walls of precast, prestressed concrete panels including panels having safety walks;
shimming the side wall panels to line and grade;
erecting a center wall of precast, reinforced concrete panels on said toe bench;
shimming the center wall;
erecting a roof of precast, prestressed concrete panels extending between said side walls and center wall;
supporting the utilities on the roof;
sandfilling behind said side walls; and,
finishing a street over said excavation using said further soldier beams, decking beams and precast, prestressed concrete panels for support.

10. A side wall precast, prestressed concrete panel of arched rib construction for use in building a subway tunnel or the like, comprising:
a vertical portion and a duct bank portion integrally cast, said vertical portion comprising a rear flush back and a plurality of arched ribs extending forwardly from said back, two pipes partially embedded in said vertical portion and extending upwardly therefrom, and a plurality of temperature rods and stressing cables precast in said panel.

11. The panel of claim 10 further comprising a layer of bituminous concrete affixed to the rear thereof.

12. A side wall precast, prestressed concrete panel of arched rib construction for use in building a subway tunnel or the like comprising:

a vertical portion and a safety walk portion integrally cast, said vertical portion comprising a rear flush back and a plurality of arched ribs extending forwardly from said back, two pipes partially embedded in said vertical portion and extending upwardly therefrom, and a plurality of temperature rods and stressing cables precast in said panel,

13. The panel of claim 10 including further pipes embedded in the bottom thereof and protruding downwardly therefrom.

14. The method of constructing a subway or the like with utility chamber utilizing precast, prestressed concrete panels comprising the steps of:

forming spaced apart pits or trenches along the outer edges of the subway site which can be immediately covered with steel plates to permit normal traffic flow;

removing the plates and locating soldier beams at spaced positions in each pit;

excavating further and inserting timber lagging between the spaced soldier beams as excavation proceeds;

installing timber bracing and caps across the tops of the soldier beams to receive precast decking;

driving further soldier beams between the aforementioned soldier beams after the decking and bracing are removed;

excavating between the further soldier beams and constructing concrete walls along said further soldier beams longitudinally to comprise the outermost edges of the subway;

laying sewer and gas mains exterior of the concrete walls to permit ready connection to dwellings or buildings;

trenching laterally of the subway site at spaced apart locations to receive decking beams;

erecting the steel decking beams and placing concrete decking on the decking beam supports;

excavating to a level below all utilities;

supporting the utilities from the decking beams by suitable hangers and cradles to outline the utility chamber;

excavating the train tunnel;

pouring invert concrete with predetermined apertures therein:

erecting side walls of precast, prestressed, arched rib concrete panels having pipes extending upwardly and downwardly therefrom with the downwardly extending pipes fitting in selected apertures;

erecting a center wall of precast, reinforced concrete containing 3 feet by 7 feet safety niches each having pipes extending therefrom for engagement of panels;

aligning all of said panels;

erecting a mezzanine floor between said side walls and said center wall or precast, prestressed, arched rib concrete panels wherein said last mentioned panels are apertured to receive the upwardly extending pipes of said side wall panels and said center wall panels;

erecting mezzanine side walls of precast, prestressed arched rib concrete panels having pipes extending vertically upwardly and downwardly therefrom with said downwardly extending pipes being received by apertures in the mezzanine floor panels;

erecting mezzanine center columns of precast, reinforced concrete having pipes embedded therein and extending downwardly and upwardly therefrom with said downwardly extending pipes being received in apertures in the mezzanine floor;

aligning the mezzanine side wall panels and columns;

erecting a mezzanine roof of precast, prestressed, arched rib concrete panels extending between the side walls and columns with apertures thereof receiving the vertically extending pipes of said side walls and columns;

aligning the roof panels;

sandfilling behind the side wall panels;

providing duct banks in the utility chamber above said mezzanine using the roof thereof as support for the duct bank; and, finishing the road surface of said utility chamber.

15. A subway structure comprising, in combination:

a train tunnel within the earth;

an invert poured concrete flooring including a central toe bench for the tunnel;

side walls for the tunnel comprising precast, prestressed, ribbed arch concrete panels including two duct banks and walk benches and two pipes extending vertically from each side wall panel for alignment;

a center wall for the tunnel comprising precast, reinforced concrete panels, containing 3 feet by 7 feet safety niches, for support in said toe bench and each panel having two vertically extending alignment pipes;

a roof for said tunnel comprising precast, prestressed, ribbed arch panels including apertures therein to receive two pipes and extending between said side walls and said center wall; and, a finished roadway over said subway structure.

16. The subway structure of claim 15 further comprising:

a utility chamber between said roof and said roadway;

said chamber comprising poured concrete walls incorporating driven soldier beams, and decking beams supported by said soldier beams;

precast, prestressed concrete decking carried by said decking beams, in turn supporting said finished roadway; and, a duct bank supported by said roof in said utility chamber.

17. The method of completing the construction of a subway or the like having a utility chamber beneath the city streets utilizing precast, prestressed, ribbed arch concrete panels as elements of the structure wherein the utility chamber comprises poured concrete side walls incorporating soldier beams therein and having decking beams supported laterally of the utility chamber on said soldier beams and removable precast, prestressed concrete decking carried by the decking beams with sewer and gas lines being located exteriorly of the utility chamber and the utilities being suspended from the decking beams, comprising the steps of:

excavating to subgrade beneath the utility chamber while applying lagging to said soldier beams as the excavating proceeds;

pouring invert protection concrete;

applying waterproofing over the protection concrete;

pouring invert concrete and a toe bench including a longitudinal recess;

erecting side walls of precast, prestressed, ribbed arch concrete panels including panels having duct banks and panels having safety walks;

shimming the side wall panels to line and grade;

erecting a center wall of precast, reinforced concrete panels containing 3 feet by 7 feet safety niches on said toe bench supported within said recess;

shimming the center wall;

erecting a roof of precast, prestressed, ribbed arch concrete panels extending between said side walls and center walls;

applying waterproofing;

pouring protective concrete;

supporting the utilities on the roof;

sandfilling behind said side walls; and, finishing a street over said concrete decking.

* * * * *